US008714339B2

(12) United States Patent
Brun et al.

(10) Patent No.: US 8,714,339 B2
(45) Date of Patent: May 6, 2014

(54) METHOD AND DEVICE FOR TRANSFERRING PRINTED PRODUCTS

(75) Inventors: Beat Brun, Rothrist (CH); Andreas Hess, Strengelbach (CH); Christian Troxler, Rain (CH)

(73) Assignee: Mueller Martini Holding AG, Hergiswil (CH)

( * ) Notice: Subject to any disclaimer, the term of this patent is extended or adjusted under 35 U.S.C. 154(b) by 180 days.

(21) Appl. No.: 13/176,495

(22) Filed: Jul. 5, 2011

(65) Prior Publication Data

US 2012/0000747 A1 Jan. 5, 2012

(30) Foreign Application Priority Data

Jul. 5, 2010 (CH) ..... 1099/10

(51) Int. Cl.
*B65H 29/16* (2006.01)
*B65H 29/68* (2006.01)

(52) U.S. Cl.
CPC ..... *B65H 29/16* (2013.01); *B65H 29/68* (2013.01)
USPC ..... 198/370.07; 198/370.08; 198/457.01; 198/607; 198/747

(58) Field of Classification Search
USPC ..... 198/370.07–370.08, 418.6, 457.01, 198/457.06–457.07, 597–598, 607, 736, 198/747–748
See application file for complete search history.

(56) References Cited

U.S. PATENT DOCUMENTS

| | | | | |
|---|---|---|---|---|
| 4,742,921 | A * | 5/1988 | Staley | 209/539 |
| 5,180,154 | A * | 1/1993 | Malick | 271/2 |
| 5,188,355 | A * | 2/1993 | Lowell et al. | 271/225 |
| 7,975,831 | B2 * | 7/2011 | Ponti | 198/597 |

FOREIGN PATENT DOCUMENTS

| | | | |
|---|---|---|---|
| EP | 1318095 | A1 | 6/2003 |
| EP | 1795473 | A2 | 6/2007 |
| EP | 2055660 | A1 | 5/2009 |
| JP | 3026635 | A | 2/1991 |
| JP | 5097306 | A | 4/1993 |
| JP | 8165044 | A | 6/1996 |
| JP | 2007106558 | A | 4/2007 |
| WO | WO 94/13566 | A1 | 6/1994 |

OTHER PUBLICATIONS

International Search Report of CH10992010 Dated Oct. 22, 2010 With English Translation.

* cited by examiner

*Primary Examiner* — Mark A Deuble
(74) *Attorney, Agent, or Firm* — Venable LLP; Robert Kinberg

(57) ABSTRACT

A device and a method for transferring printed products conveyed in a stream of individual products from a feed unit to a removal unit makes it possible to divert the printed products from a feed direction to a removal direction. The feed unit includes a first conveyor and a transfer region, and the removal unit includes a takeover region with a support surface for the printed products. The transfer region is located higher than the takeover region. The removal unit of the device includes at least a second conveyor which forms the support surface. A pressing element is arranged above the support surface which can be lowered toward the support surface or toward a printed product moving in the direction of the support surface. The pressing element can be lifted up from the support surface or a printed product positioned thereon.

22 Claims, 8 Drawing Sheets

Fig. 3a
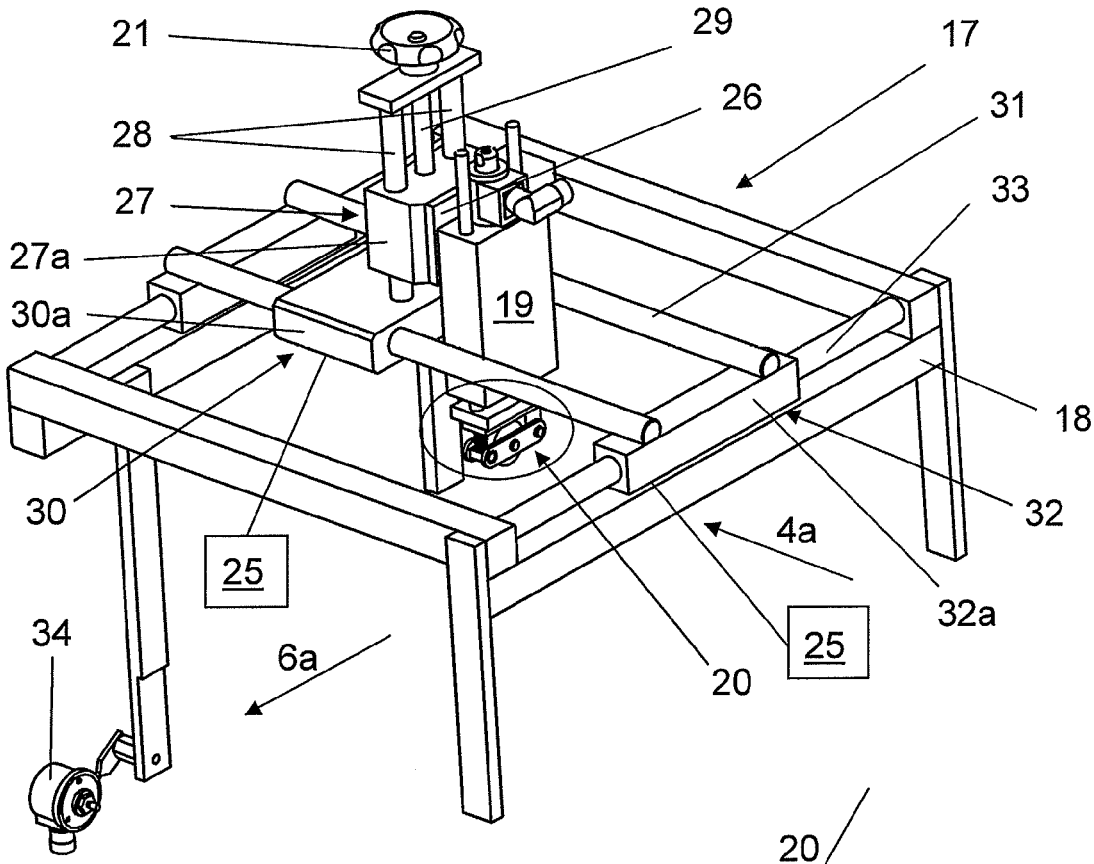
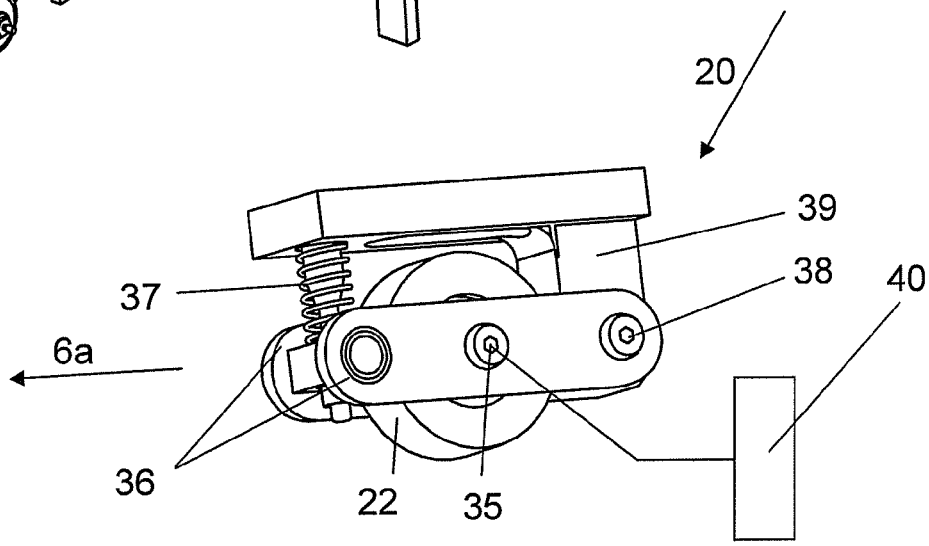
Fig. 3b

METHOD AND DEVICE FOR TRANSFERRING PRINTED PRODUCTS

CROSS-REFERENCE TO RELATED APPLICATION

This application claims the priority of the Swiss Patent Application No. 01099/10, filed on Jul. 5, 2010, the subject matter of which is incorporated herein by reference in its entirety.

BACKGROUND OF THE INVENTION

The invention relates to a device for transferring printed products, conveyed in a single stream from a feed unit to a removal unit, which device can be used to divert the printed products from a feed direction to a removal direction, wherein the feed unit is provided with a first conveyor as well as a transfer region and the removal unit comprises a takeover region with a support surface for the printed products, and wherein the transfer region is arranged above the takeover region.

The invention furthermore relates to a method for transferring printed products in a stream of individual printed products from a feed unit to a removal unit whereby the printed products are transferred from a transfer region of the feed unit to a support surface, arranged below the transfer region, of a takeover region of the removal unit and are diverted from a feed direction to a removal direction.

During a print finishing step, devices are frequently used which can divert the printed products during transport. These types of devices, which are also referred to as angle diverters, must meet high precision requirements for orienting the printed products following the diverting and should not mark or damage the printed products and possibly existing inserts. Within the meaning of this application, the printed products are understood to be finished products, such as perfect-bound magazines, booklets, catalogs, newspapers and magazines, and also partial products such as individual sheets, signatures and book blocks as well as similar products.

European patent document EP 2055660 A1 describes a device for the conveying and clocked diverting of flat objects, in particular printed products conveyed in an overlapping or scaled formation. The device can furthermore be used to process products conveyed in a single stream, meaning a sequence of non-overlapping and spaced apart printed products, wherein a spacing of this type between two successively conveyed printed products is also called a product division.

The device comprises a feed unit, a removal unit, a diverter unit with a stationary support surface, at least one pair of diverter elements and an end stop. The diverter elements rotate in the direction of the removal unit and are arranged so that a printed product is transported to the removal unit while held between the bearing surfaces of the diverter elements. The circumference of the diverter elements is designed such that the size of the gap between the running surfaces can alternate between two values. While the running surfaces of the diverter elements have a larger gap, a printed product which is supplied by the feed unit arrives at the removal unit and, in the process, impacts with an end stop. The gap between the running surfaces of the diverter elements is subsequently reduced, so that during the further conveying the printed product is clamped in between the diverter elements. The alternating between gap sizes must match the belt speed and must be synchronized with the clocking of the arriving printed products. The diverter elements rotate with the constant speed of the removal unit.

The aforementioned device has the disadvantage that the printed products can be marked and/or damaged as a result of being stopped at the end stop. Since the printed products are initially stopped by the end stop and are then accelerated once more, following the transfer of the printed products from the feed unit to the removal unit, the device can be used only with relatively slow conveying speeds. As soon as irregularly spaced-apart printed products are supplied to the device, the danger of a latent jamming exists in the region of the uniformly rotating diverter elements. Since the printed products are clamped in by the diverter elements only in the area immediately adjacent to the leading edge of the printed products, as seen in feed direction, inserts for the printed products can only be conveyed securely in this area and starting with the instant when the products are clamped in. The above-described solution therefore results in the danger of displacement or of ejecting loose inserts, even at median processing speeds.

SUMMARY OF THE INVENTION

In view of the above, it is an object of the present invention to provide a device and a method which permit a careful transfer of diverted printed products, even at higher conveying speeds, as well as a secure transport of loose inserts.

This object is solved by providing the removal unit with a second conveyor, which forms at least the support surface, by arranging at least one pressing element above the support surface which can be lowered in the direction of the support surface or toward a printed product in the stream of individual products and which is furthermore embodied to be lifted off the support surface or a printed product arranged thereon.

The object is furthermore solved with a method for transferring printed products, designed to slow the printed products during the transfer in feed direction already and to press the products against the support surface during the diverting operation, as well as to accelerate the products in removal direction.

According to one embodiment, there is provided a device to transfer printed products conveyed in a stream of single products, comprising: a feed unit including a first conveyor that conveys the stream of single products in a feed direction, wherein the feed unit includes a transfer region; a removal unit including a second conveyor to convey the printed products in removal direction, wherein the removal unit includes a takeover region and the second conveyor presents a support surface for the takeover region, wherein the transfer region is arranged higher than the takeover region which receives the printed products from the transfer region of the first conveyor, whereby the printed products are diverted from the feed direction to the removal direction during transfer from the feed unit to the removal unit; and a pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface.

According to another embodiment there is provided a method to transfer printed products conveyed in a stream of individual printed products by a first conveyor of a feed unit to a removal unit, comprising: transferring the printed products from a transfer region of the feed unit to a support surface, arranged below the transfer region, of a takeover region of the removal unit, the transferring including diverting the printed products from a feed direction to a removal direction; slowing down the printed products in the feed direction during the transferring; pressing the printed products, respectively, against the support surface of the takeover region during the transferring; and accelerating the printed products, respectively, in the removal direction during the diverting step.

The device and the method for transferring printed products permit a careful treatment of the printed products to be transferred and diverted since the products are not stopped by a sudden impact against an end stop, but are actively slowed by a frictional effect in the feed direction as a result of applying pressure from above with the pressing element. This early and continuous contact between the pressing element and the printed products furthermore ensures a guided transfer of the printed products from the feed unit to the removal unit, as well as a continuous diverting from the feed direction to the removal direction, wherein the inserts remain securely inside the printed product or attached thereto during the transfer as well as the diverting of the products resting on the support surface in the takeover region of the removal unit.

The first conveyor has an imagined center line that runs parallel to the feed direction while the second conveyor has an imagined center line that runs parallel to the removal direction. A first vertical plane through the center line of the first conveyor and a second vertical plane through the center line of the second conveyor have a joint intersecting line. The pressing element is advantageously arranged at least approximately in the area of this intersecting line. Owing to this arrangement, the pressing element can be lowered relatively early toward a printed product in the stream of individual products moving in the direction of the support surface in the takeover region of the removal unit.

According to an embodiment, the printed product may be pressed approximately in the center against the support surface, meaning against the second conveyor, thereby resulting in a relatively long period during which the pressing element remains pressed against the printed product conveyed in the removal direction by the second conveyor. The relative speed between the printed product and the second conveyor is therefore negligibly low at the point of impact between the printed product and the support surface and is furthermore reduced to zero immediately after the impact. The above-described arrangement of the pressing element thus ensures an even faster, more careful and secure transfer, diverting and removal of the printed product, including possibly existing inserts.

As a result of the height-adjustable design of the pressing element, the pressing element may be adapted to the thickness of the printed products to be processed.

According to an embodiment, the device is provided with a drive for the first conveyor, a drive for the second conveyor, at least one drive for the pressing element, a detection device for detecting a printed product conveyed in the feed unit, as well as a control unit, wherein the control unit is connected at least to the aforementioned drives as well as to the detection device. The lowering and the raising of the pressing element, relative to the support surface of the takeover region for the removal unit, can thus be synchronized with a product division for the stream of individual printed products on the first conveyor and/or with a format of the printed products.

According to one embodiment of the device, the pressing element is provided with at least one pressure roller that can rotate in the removal direction, is attached to its drive and is arranged together with the drive inside a pressing unit, such that it can be lowered and lifted jointly with this drive.

The respective printed product positioned on a trajectory is admitted with pressure from the top by the pressure roller, wherein the top of the printed product rubs against the lower part of the operating surface of the pressure roller. The printed product moving along the trajectory is thus delayed, that is slowed down, in the feed direction and its speed component is slowed to zero once it impacts with the second conveyor which forms the support surface of the takeover region. Through a continued pressing of the printed product against the support surface with the aid of the pressure roller, its friction with the second conveyor is increased, thus counteracting the inertia of the printed product which at that instant has a low speed component in removal direction. As a result, the printed product can be diverted and accelerated immediately after impacting with the support surface of the takeover region for the removal device. The design of the pressure roller which can rotate in the removal direction thus ensures a careful acceleration of the printed product.

The drive is advantageously connected to a first, vertically movable slide, wherein the first slide is arranged on a second slide, so as to be displaceable in and counter to the feed direction and wherein the second slide is arranged on a third slide, so as to be displaceable in and counter to the removal direction along a frame of the press-on unit. As a result of this arrangement, the pressing element and its pressure roller can be positioned easily in three-dimensional space, corresponding to the requirements for the transferring and diverting of the printed products.

By embodying the drive for the pressing element as a linear motor with a fixed or a variable stroke, it is possible to achieve an extremely short reaction time for the pressing element and thus an increased rate of flow for the printed products. Above all, this is due to the high dynamic of linear motors which allow considerably higher accelerations than possible with three-phase motors. Of course, servo motors, pneumatic cylinders, or other drives known to one skilled in the art can alternatively also be used.

An additional drive that is connected to a shaft of the pressure roller may also be provided. This additional drive may function to generate, accelerate and/or decelerate a rotational movement of the pressure roller, thereby adapting and optimizing the acceleration of the printed product to a concrete working situation.

The pressing element of a different embodiment of the device is provided with at least one pressing ram, connected to its drive so as to be movable with the speed of the second conveyor in the removal direction or counter to the removal direction, as well as a guide curve for lowering and raising the pressing ram. With this relatively simple and cost-effective solution, the pressing ram accompanies the printed product over a longer distance in the removal direction by pressing it approximately in the center against the second conveyor, thereby counteracting a twisting of the printed product on the second conveyor.

According to yet another embodiment of the device, the pressing element is provided with at least one pressing ram that can be lifted up and lowered with its drive and is connected to a different drive, so as to be movable along guide elements of the removal unit in the removal direction or counter to that direction. Through a combination of the first and the second drive, the instant of pressing on as well as the interval during which the pressing element is pressed on can be controlled. When using a linear motor with variable stroke, it is furthermore possible to adjust the thickness automatically. As a result, printed products with different formats can advantageously be processed successively. A linear motor with a fixed stroke can also be used, wherein this requires a different adjustment of the pressing element to the thickness of the printed products to be processed, for example with the aid of an additional drive or an adjusting wheel.

The pressing element of yet another embodiment of the device is provided with a stationary disk, connected to its drive, which rotates at a variable speed, as well as at least one pressing ram which is rigidly connected to the disk and can be lowered and lifted up by rotating the disk relative to the support surface in the takeover region. By increasing the disk diameter and increasing the number of pressing rams arranged on the disk, the number of printed products to be processed can be increased considerably without a substantial increase in the vertical acceleration.

The device may be provided with at least two pressing elements which are arranged in the removal direction one behind the other, thus preventing a twisting of the printed products on the second conveyor.

In the transfer region for the feed unit, at least one pressure roller is advantageously arranged for pressing against the printed products. This roll functions to accelerate or delay a printed product, conveyed on the first conveyor, to match its conveying speed.

Finally, a unit for transferring out the printed products is arranged on a side of the removal unit which is located opposite the transfer region of the feed unit. This transfer-out unit makes it possible to transfer selected printed products out of the conveyed stream, in a direction that deviates from the removal direction. The lowering and raising of the pressing element with the aid of the respective drives is suppressed in that case. This function can be used, for example, for quality control, so as to select and also check random samples of printed products from the normal production run and to transfer out products of poor quality.

BRIEF DESCRIPTION OF THE DRAWINGS

These and other features and advantages of the invention will be further understood from the following detailed description with reference to the accompanying drawings, which show in:

FIG. 3*a* A perspective view of a press-on unit according to FIG. 1;

FIG. 3*b* An enlarged detail from FIG. 3*a;*

DETAILED DESCRIPTION

The Figures only show the components which are essential to the operation and have been given reference numbers, wherein the same reference numbers refer to the same components and/or components having the same effect.

Figure 1:
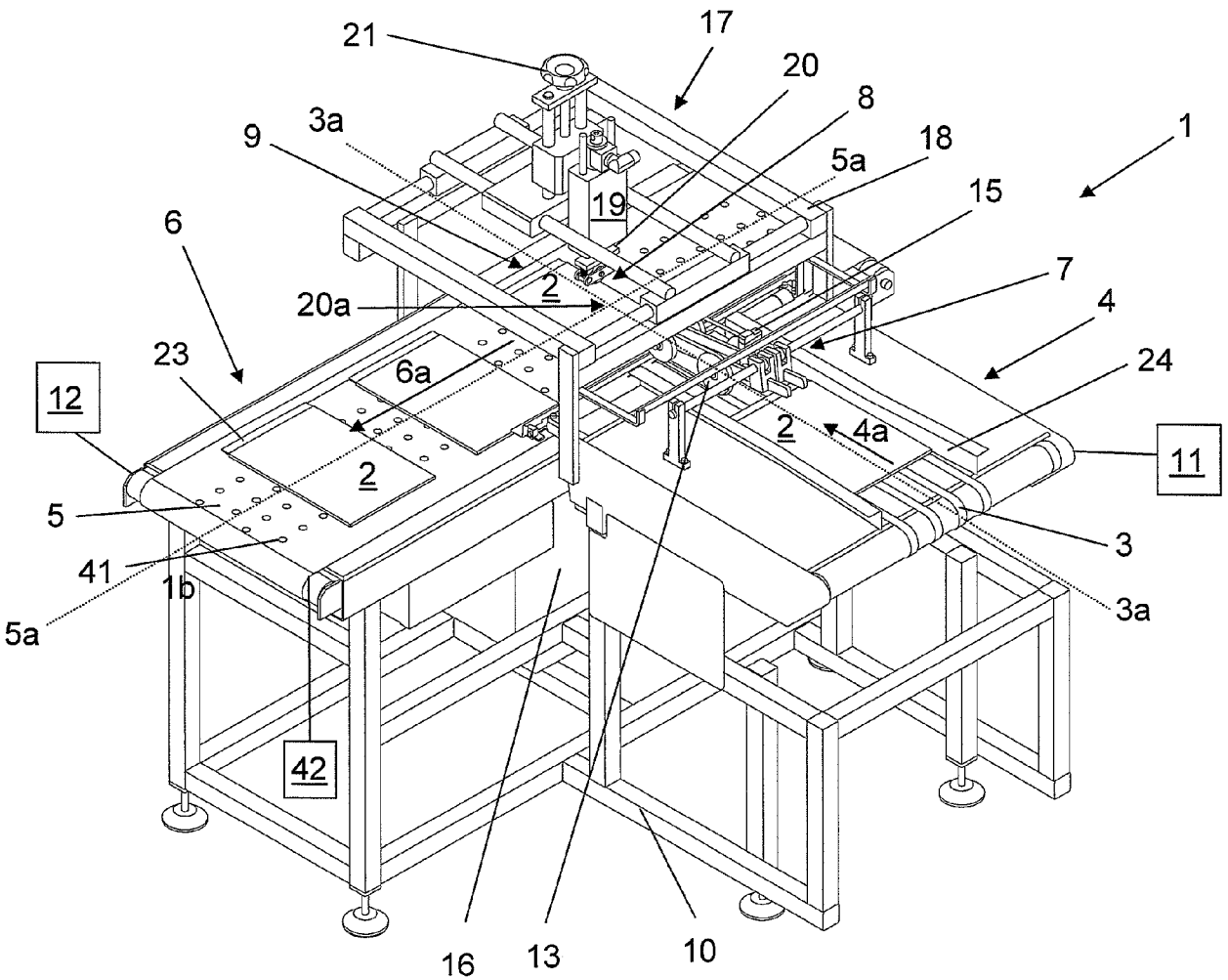
FIG. 1A perspective view of an embodiment of a device for transferring printed products.

FIG. 1 shows a first embodiment of a device 1 for transferring printed products 2, supplied in the form of a stream of individual printed products, from a feed unit 4 provided with a first conveyor 3 to a removal unit 6 provided with a second conveyor 5. The feed unit 4 comprises a transfer region 7 for transferring the printed products 2 to a takeover region 8 of the removal unit 6, wherein the transfer region 7 is arranged above the takeover region 8. The second conveyor 5 forms a support surface 9 for the takeover region 8 and extends from there to the downstream end of the removal unit 6. The feed unit 4 and the removal unit 6 are mounted on a frame 10 of the device 1 and are respectively provided with the conveys 3, 5 with separate drives 11, 12. Of course, the feed unit 4 and the removal unit 6 can also be mounted on separate frames for easier replacement, wherein this can be advantageous if maintenance operations must be carried out on a unit and a production stop is desired within the shortest possible time. Of course, other suitable conveyors can also be used for the feed unit 4 and the removal unit 6 in place of the conveyors 3, 5, embodied as conveying belts, wherein the units can respectively also be provided with several conveyors 3, 5.

In the following, the components of the device 1 are initially described. Following this, the path taken by a printed product 2 is described, starting with its arrival on the first conveyor 3 of the feed unit 4 to its removal from the second conveyor 5 of the removal unit 6 to a downstream-arranged further processing machine which is not shown herein.

The printed products 2 are transferred from a processing machine, which is also not shown herein, in a feed direction 4*a* of the feed unit 4 to the first conveyor 3 and are then transported in the direction of the takeover region 8 of the removal unit 6. The takeover region 8 is a region on the second conveyor 5, arranged downstream of the transfer region 7 of the feed unit 4, in which the printed product 2 is transferred to the removal unit 6. The transfer region 7 of the feed unit 4 thus ends above the takeover unit 8, meaning above a side edge of the removal unit 5 that is oriented toward the feed unit 4. Four pressure rollers 13 are arranged in the transfer region 7 of the feed unit 4 which roll off the printed products 2, thereby causing a correction in the speed of the printed products 2 conveyed with the feed unit 4, such that the printed products move at the same speed as the first conveyor 3 and thus at the correct speed for entering the removal unit 6. Of course, the number of pressure rollers 13 in FIG. 1 is selected only as example, meaning it is possible to use only one, or also two or more than four pressure rollers 13. Upstream of the pressure rollers 13 and above the first conveyor 3, a detection device 15, preferably embodied as a light barrier, is arranged on a frame 14 of the feed unit 4. The detection device is designed to detect the arrival of a printed product 2 in the transfer region 7 of the feed unit 4. The function of the pressure rollers 13 and that of the detection device 15 will be described in further detail in connection with the explanation provided for the feed unit 4, shown in FIG. 2.

A control unit 16 is provided below the removal unit 6 for coordinating the different sequences during the transfer and the subsequent diverting of the printed products 2, as well as for adjusting additional parameters. Of course, the control unit 16 can also be arranged at any other suitable location on the device 1.

In addition to the feed unit 4 and the removal unit 6, the device 1 also comprises a press-on unit 17 which is arranged above the takeover region 8 of the removal unit 6. The press-on unit 17 comprises a frame 18, a drive 19 and a pressing element 20 that is connected to the drive 19. The pressing element 20, which in the idle position is located above the takeover region 8, can be moved cyclically in an at least approximately vertical direction, relative to the support surface 9 of the takeover region 8. That is to say, it is embodied such that with each printed product 2 it can be lowered toward the support surface 9 and can also be lifted off this surface again. The press-on unit 17 furthermore comprises an adjustment wheel 21 for the vertical adjustment of the idle position of the pressing element 20. The idle position of the pressing element 20 is simultaneously also its upper position which predetermines the maximum thickness of the printed product 2 that can be processed with the device 1. Of course, the movement function of the pressing element 20 can also be turned off as needed.

The first conveyor 3 has an imagined center line 3*a* that extends parallel to the feed direction 4*a* while the second conveyor 5 has an imagined center line 5*a* which extends parallel to the removal direction 6*a*. A first vertical plane through the center line 3*a* of the first conveyor 3 and a second vertical plane through the center line 5*a* of the second conveyor 5 have a joint intersecting line 20*a*. The pressing element 20 is arranged at least approximately in the region of this joint intersecting line 20*a*.

Following the takeover from the feed unit 4, the printed product 2 that is positioned on the support surface 9 of the takeover region 8 of the removal unit 6 is diverted to the removal direction 6*a* and is then conveyed further with the second conveyor 5, so that it can finally be transferred to a further processing device which is not shown herein. For this, the second conveyor 5 is arranged at a right angle to the first conveyor 3, so that the printed products 2 are advantageously diverted at a right angle. Of course, the products can also be diverted to a different direction when using a corresponding arrangement of the conveyors 3 and 5.

In the following, the basic mode of operation of the device 1 is explained with the example of a printed product 2 to be transferred from the feed unit 4 to the removal unit 6. Not all aspects and adjustment options are explained herein, but only the transfer and diverting operation. Additional aspects become clear upon closer observation of the feed unit 4, the removal unit 6 and the press-on unit 17, in connection with FIGS. 1 to 3*b*.

The printed product 2 is transported with the first conveyor 3 in the feed direction 4*a* to the transfer region 7 of the feed unit 4 and is then transferred to the removal unit 6. Owing to its inertia, the printed product 2 does not drop vertically downward once it leaves the feed unit 4, but rather describes a trajectory in the direction of the support surface 9 of the takeover region 8 of the removal unit 6. As soon as the detection device 15 detects the rear edge of a printed product 2 that is transported on the first conveyor 3, it transmits a corresponding signal to the control unit 16 which, in turn, triggers a signal for lowering the pressing element 20 with the pressure roller 22 from its idle position in the direction of the takeover region 8. The printed product 2 along the trajectory is consequently admitted with pressure from above by the pressure roller 22, thereby supporting its movement in the direction of the support surface 9 of the takeover region 8. Since the printed product 2 still has a speed component in feed direction 4*a* at this point in time, it rubs with its top side against the lower part of the effective surface of the pressure roller 22. The printed product 2 already moving along the trajectory is thus delayed, i.e. slowed down, early on in feed direction 4*a* and its speed component will be zero when it impacts with the support surface 9 of the takeover region 8. Following the impact, the pressure roller 22 of the pressing element 20 continues to press the printed product 2 against the support surface 9 and thus the second conveyor 5, thereby counteracting the inertia of the speed component, low at this point in time, of the printed product 2 in removal direction 6*a*. Without pressing on the product, an undesirable relative speed would initially develop between the printed product 2 and the second conveyor 5, before the printed product 2 is accelerated as a result of the friction caused by its weight to the speed of the second conveyor 5. Of course, that is the more problematic, the lighter the weight of the printed product 2. With a free flight of the printed product 2, an air cushion could furthermore form between the printed product 2 and the second conveyor 5, just prior to the deposit on the support surface 9 of the takeover region 8, resulting in the danger of an uncontrolled slipping away of the printed product 2. The above-described continued pressing on of the printed product 2 increases its friction on the second conveyor 5. As a result, the printed product 2 is diverted to the removal direction 6*a*, immediately after impacting with the support surface 9 of the takeover region 8, and is accelerated to the speed of the second conveyor 5. The printed product 2 thus comes in contact with the pressure roller 22 during the transfer from the feed unit 4 to the removal unit 6, meaning before it impacts with the takeover region 8. The pressure roller 22 continues to press the printed product 2 against the second conveyor 5, even during the immediately following diverting step, thereby aiding the acceleration to the speed of this second conveyor. This early and continuous contact between the pressure roller 22 and the printed products 2 ensures a guided transfer of the printed products from the feed unit 4 to the removal unit 6, as well as a continuous diverting from the feed direction 4*a* to the removal direction 6*a*.

Following a certain dwell time for the pressure roller 22 in the position where it is lowered onto the printed product 2, which can be adjusted with the control unit 16 and preferably lasts until the printed product has reached the speed of the second conveyor 5, the pressing element 20 and thus also the pressure roller 22 are lifted up once more to the idle position with the aid of the drive 19, and the printed product is released to be conveyed further with the second conveyor 5. The removal unit 6 is then ready to take over a following printed product 2.

According to FIG. 1, the printed products 2 may be provided with loose inserts 23, for example brochures or other types of inserted products. Owing to the effect of the pressure roller 22, an essentially continuous guidance of the printed products 2 is achieved during the transfer from the feed unit 4 to the removal unit 6 instead of an undefined, free flight, so that the inserts 23 cannot drop out or be thrown out and will remain in the exact position inside the printed products 2. In contrast, known devices of the generic type, such as the device disclosed in the above mentioned document EP 2055660 A1, carry the danger that the loose inserts 23 can be thrown out or drop out.

Figure 2:
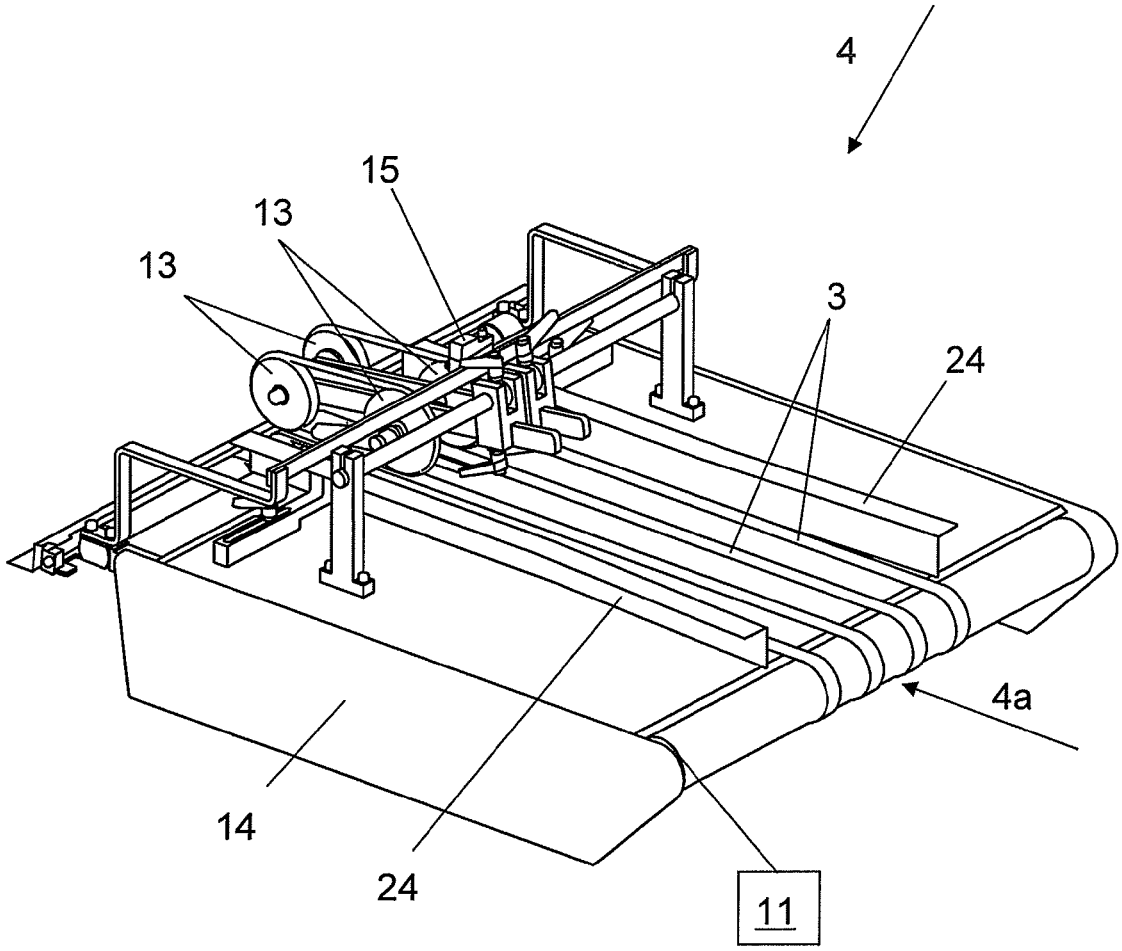
FIG. 2 A perspective view of a feed unit according to FIG. 1.

FIG. 2 shows the feed unit 4 of the device 1 according to FIG. 1. The first conveyor 3 for this example comprises several spaced-apart belts, arranged parallel to each other, which are oriented in the feed direction 4*a*, wherein the conveyor can, of course, also consist of a single belt. The first conveyor 3 is preferably embodied such that it can telescope in order to adapt the device 1 to the transfer of printed products 2 with different formats. For example, if a small printed product 2 is conveyed, the first conveyor 3 embodied in this way can be extended in the transfer region 7 of the feed unit 4 in feed direction 4*a*, so as to ensure that during the transfer to the removal unit 6 the printed product 2 can be conveyed sufficiently far in the feed direction 4*a* to the support surface 9 of the takeover region 8. In the process, the transfer region 7 of the feed unit 4, arranged above the takeover region 8 of the removal unit 6, can project over a distance into the removal unit 6.

Sheet metal guides 24 are arranged in the region upstream of the feed unit 4 on both sides of the first conveyor 3, wherein these function to center the printed products 2 on the feed unit 4.

In the transfer region 7 of the feed unit 4, two side-by-side positioned pressure rollers 13 are arranged in front and two side-by-side positioned pressure rollers are also arranged in back, relative to the feed direction 4*a*, which roll off the printed products 2. The number of pressure rollers 13 selected for this embodiment is by way of example and be different, depending on the configuration of the device 1. The pressure rollers 13 are used to impress the speed of the first conveyor 3 onto the printed products 2 in the transfer region 7 of the feed unit 4. As a result and following the exit from the feed unit 4, the printed products 2 can be transferred at the correct instant of the cycle to the removal unit 6 and do not collide along the trajectory with the pressure roller 22 of the pressing element 20.

An upper belt, not shown herein, can also be arranged above the first conveyor 3 as alternative to the pressure rollers 13. The pressure rollers 13 as well as the upper belt can be driven with the aid of a motor, not shown herein, and always operate at the same speed as the first conveyor 3.

The detection device 15 which is arranged on the frame 14 of the feed unit 4 functions to detect the edges of the printed products 2 and thus the product division of the stream of individually conveyed printed products 2 that are conveyed on the first conveyor 3, wherein these edges extend transverse to the feed direction 4*a*. In particular the rear edge of a printed product 2, as seen in feed direction 4*a*, and the front edge of the following printed product 2 are detected in order to determine the spacing between the edges and/or the printed products 2. Based thereon, the time for lowering and lifting the pressing element 20 can be determined and a collision avoided between the front edge of the following printed product 2 and the pressure roller 22. Distance measurements obtained with the aid of light barriers are known sufficiently well and are therefore not explained further herein.

FIG. 3*a* shows the press-on unit 17 of the device 1 while FIG. 3*b* shows an enlarged view of the pressing element 20 with its pressure roller 22. The drive 19 supports the pressing element 20 and is attached to a holder 26. The holder 26 is connected to a first, vertically movable slide 27. The first slide 27 is provided with a sliding member 27*a* which can be displaced along two guide rods 28 and can be acted upon by the adjustment wheel 21 via a threaded rod 29. Depending on the thickness of the printed products 2 and the inserts 23 to be processed, the idle position of the pressing element 20 and thereto connected drive 19 can be adjusted with the adjustment wheel 21. The first slide 27, in turn, is supported on a second slide 30 which is also provided with a sliding member 30*a* and two guide rods 31, wherein the sliding member 30*a* accommodates the guide rods 28 of the first slide 27 and can be displaced horizontally along the guide rods 31 of the second slide 30 in feed direction 4*a* as well as counter to the feed direction. The second slide 30 is arranged on a third slide 32. The third slide 32, in turn, comprises respectively one sliding member 32*a* arranged on a guide rod 33 on each side, designed to move the third slide horizontally in removal direction 6*a* as well as counter thereto inside the frame 18 of the press-on unit 17 which is connected to the removal unit 5. For this, the ends of the guide rods 31 of the second slide 30 are arranged on both sides on the respective sliding member 32*a* of the third slide 32, so that the guide rods 31 simultaneously also form a component of the third slide 32. With this type of arrangement, the pressing element 20 and its pressure roller 22 can be positioned easily in the three-dimensional space, corresponding to the requirements for the transferring and diverting of the printed products 2. Analogous to the vertical adjustment of the idle position of the pressing element 20, non-depicted adjustment wheels can furthermore be used to make basic adjustments to the pressing element 20 and the pressure roller 22 in a horizontal plane which extends parallel to the support surface 9 in the takeover region 8. Of course, these adjustment operations can also be realized automatically with the aid of stepping motors which are connected to the control unit 16 for this.

By connecting the first, second and third slides 27, 30, 32 including the drives 25 to the control unit 16, the device 1 can be set up to operate fully automatically, meaning considerably faster, and in connection with an automatic adjustment of the idle position of the pressing element 20 can also be used for processing successively following printed products 2 having different formats.

A sensor 34 that may be embodied as a rotary encoder and aimed toward the second conveyor 5 is arranged on the frame 18 of the press-on unit 17, wherein this sensor is used for measuring an acceleration time and/or an acceleration distance for the printed product 2 which is conveyed on the second conveyor 5. The position of the sensor 34 shown in FIG. 3*a* illustrates a suitable location for taking the measurement. Of course, the sensor 34 can also be arranged on the removal unit 6.

The pressure roller 22 of the pressing element 20 is attached so as to rotate around a shaft 35 which, in turn, is attached on each end to respectively one holding bracket 36. A compression spring 37 is arranged downstream of the pressure roller 22, in the removal direction 6*a*, and is also attached to the holding brackets 36. This compression spring functions to adjust a pressing force exerted upon the printed product 2 and to compensate for the product thickness, for example if the printed product 2 does not contain inserts. Of course, this adjustment can alternatively also be made via the drive 19.

In its upstream region, relative to the removal direction 6*a*, the pressure roller 22 is attached with the aid of the holding brackets 36 to a main support 39, such that it can be rotated with a pivoting lever 38 in the removal direction 6*a*, and is attached via this main support to the drive 19. In order to generate, accelerate and/or slow down a rotational movement of the pressure roller 22, its shaft 35 is connected to a further drive 40, for example a drive controlled by the control unit 16. The advantage of such a solution is that it actively supports the acceleration of the printed product 2 on the removal unit 6 as a result of the friction generated by the driven pressure roller 22 in connection with the force exerted onto the top surface of the printed product 2. However, the pressure roller 22 need not be driven actively. In that case, the speed of the second conveyor 5 is transmitted while the pressure roller 22 is pressed against the printed product 2.

The pressure roller 22, in particular, can be replaced with a different pressure roller 22 having a different width for its operative surface, wherein a different degree of friction can be generated as needed during the slowing down of the printed product 2 along the trajectory and/or during the accelerating of the printed product 2 in removal direction 6*a*. The pressure roller 22 can furthermore also be selected in dependence on the surface or the weight of the printed product 2. For example, a pressure roller with a higher frictional coefficient can be selected for an optimum deceleration of a printed product 2 with an extremely smooth surface compared to a printed product 2 with a rough surface.

The material and the weight represent further degrees of freedom when selecting a suitable pressure roller 22, wherein a soft material with a high friction coefficient is preferably selected for the pressure roller 22 to increase the deceleration and/or acceleration effect. The weight of the pressure roller 22 and that of the complete pressing element 20, comprising the shaft 35, the holding brackets 36, the pivoting lever 38, the main support 39 and the compression spring 37, should furthermore be kept low. As a result, the dynamic of the drive 19 can be used to the maximum degree for moving the pressure roller 22 in vertical direction while its inertia can be overcome as quickly as possible during the acceleration of the printed products 2 in the removal direction 6*a*.

The drive 19 for controlling the vertical movement of the pressure roller 22 may be embodied as a linear motor with a fixed stroke. For this embodiment, the press-on unit 17 is adjusted to the maximum thickness of the printed products 2 for the order to be processed, and the idle position of the pressure roller 22 is thus adjusted either with the adjustment wheel 21 or with the aid of an additional drive that is not shown herein. In place of an additional drive, a linear motor with variable stroke can also be used which controls the vertical movement of the pressure roller 22 as well as its adjustment to the product thickness. Of course, other types of drives such as servo-motors or pneumatic cylinders can also be used. The device 1 provided with the drives 25 for the second and the third slides 30, 32, the drive 19 for the pressing element 20 which is embodied as a linear motor with variable stroke, as well as the first slide 27, is advantageously also suitable for processing different formats of successively following printed products 2.

This is also possible when using a drive 19 embodied as linear motor with fixed stroke, but requires an additional drive in that case which is not shown herein.

Figure 3C:
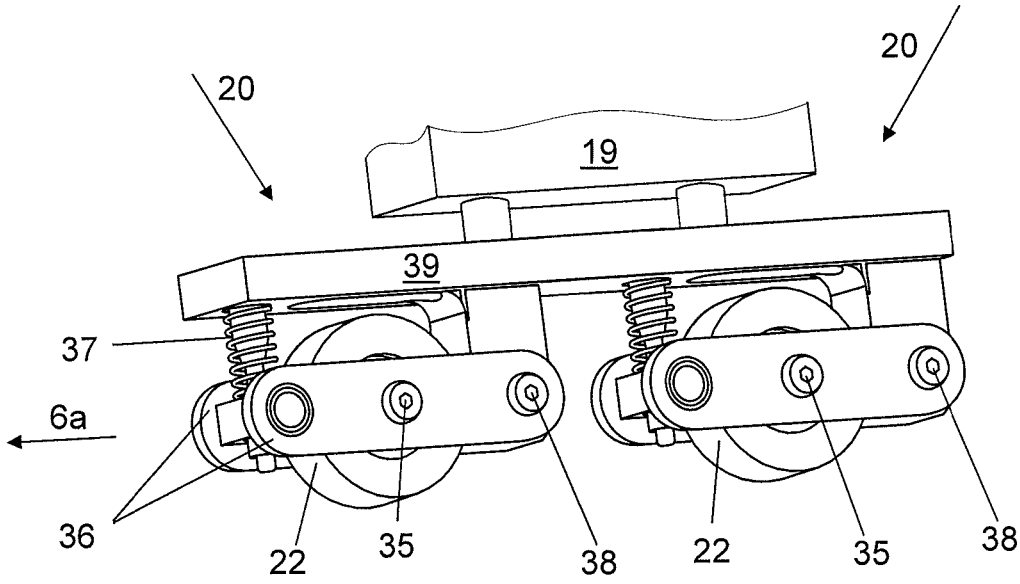
FIG. 3*c* A variation of FIG. 3*b* showing a pressing element with two successive pressure rollers.

Of course, in place of a single pressure roller, at least two pressure rollers 22 can be provided which are arranged successively one behind the other relative to the removal direction 6*a*, as shown in FIG. 3*c*. For this, the pressure rollers 22 can be arranged either in a single pressing element 20, as illustrated, or in several pressing elements 20. The use of at least two pressure rollers 22 has the advantage of preventing the development of a rotational moment either during the deceleration of the printed product 2 along its trajectory or during the subsequent acceleration on the second conveyor 5. In contrast, a rotational moment of this type can develop when using a single pressure roller 22 that exerts a force not precisely in the center of the printed product 2, thereby leading to an incorrect orientation of the printed product 2 during the further transport or damage to the printed product.

The idle position of the pressing element 20 and/or the pressure roller 22 is adjusted as described in the above and in dependence on the format of the printed product 2. It must be considered in this case that when the pressure roller 22 is lowered in the region of a leading edge of the printed product 2, as seen relative to the removal direction 6*a*, it comes to rest approximately in the center of the printed product, as seen in the feed direction 4*a*. The pressure roller 22 can thus act upon the printed product 2 over a maximum distance during the following acceleration of the printed product in the removal direction 6*a*. The pressure roller 22 thus acts over nearly the complete length, extending in the removal direction 6*a*, onto the printed product 2, thereby making available more time for accelerating it to the speed of the second conveyor 5. As a result, the acceleration profile can be designed gentler and the probability of markings on the printed product 2 can be reduced. The sensor 34 is advantageously used to measure an acceleration time and/or an acceleration distance for the printed product 2, which is pressed by the pressure roller 22 against the conveyor 5. The pressing element 20 and thus also the pressure roller 22 is lifted up following a desired acceleration time and/or a desired acceleration distance for the printed product 2. In other words, the pressure roller 22 is kept in the pressed-on state until the sensor 34 has counted a specified number of increments.

A further criterion used for the adjustment of the idle position, meaning in particular the height position of the pressure roller 22 relative to the second conveyor 5, can also be the height position of the transfer region 7 for the first conveyor 3. The height position of the idle pressure roller 22 in each case must be higher than the position of the transfer region 7, so that the printed product 2 does not hit the pressure roller 22 during the transfer from the feed unit 4 to the removal unit 6.

The adjustment of the device 1 to the thickness of the printed products 2 to be transferred and diverted can be realized with a vertical movement of the press-on unit 17 and thus the pressure roller 22, or also with a corresponding vertical adjustment of the second conveyor 5 and/or the complete removal unit 6.

As shown in FIG. 1, the second conveyor 5 of the device 1 is provided with vacuum holes 41 which function to suction the printed products 2, conveyed on the conveyor 5, against this conveyor. As soon as a printed product 2 rests on the second conveyor 5, a vacuum pressure is generated with a vacuum source 42, which is only indicated in FIG. 1 and is connected to the second conveyor 5, and this vacuum is applied via the vacuum holes 41 to the underside of the printed product 2, thereby causing these products to adhere even better to the second conveyor 5. The generated vacuum functions to help accelerate the printed products 2 to the speed of the second conveyor 5, wherein this occurs immediately after the printed products arrive at the takeover region 8. The vacuum furthermore prevents the forming of air cushions between the printed products 2 and the second conveyor 5, meaning the deposit of the printed products in the takeover region 8 occurs faster. Vacuum belts of this type are known and will not be described in further detail herein.

Figure 4A:
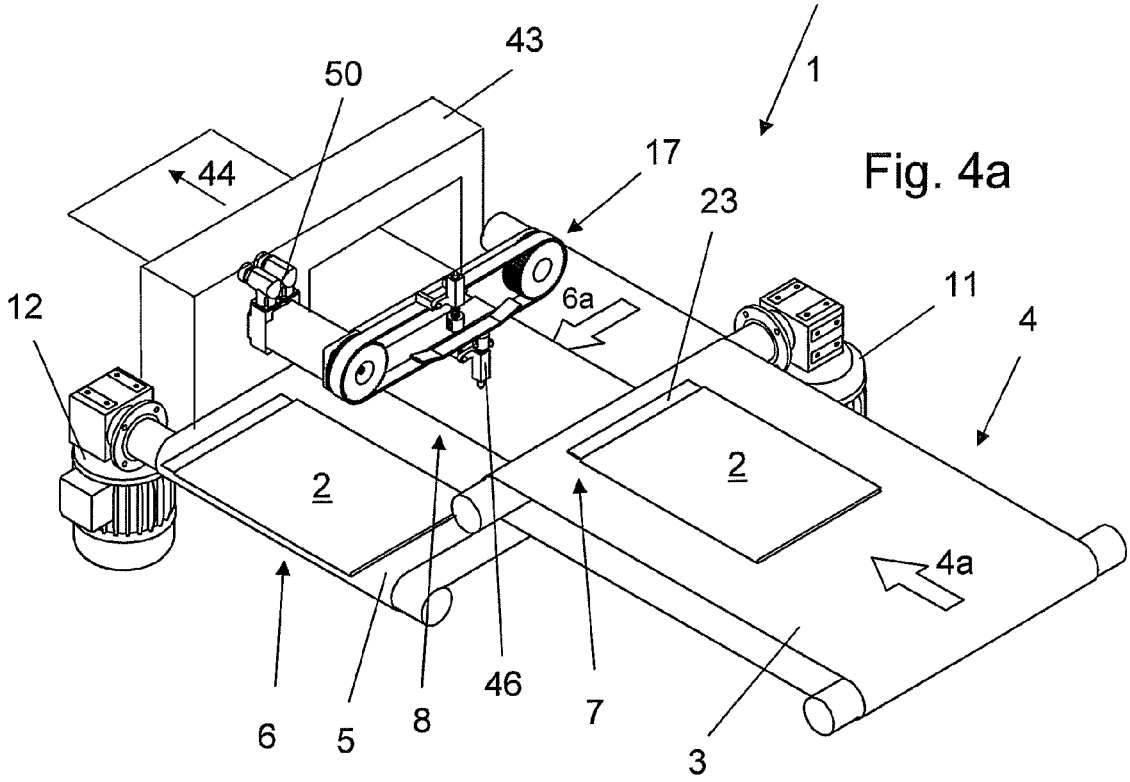
FIG. 4*a* A perspective view of a second embodiment of a device for transferring printed products.

FIG. 4*a* shows a perspective view of a second embodiment of the invention. For this embodiment as well as the embodiments described in the following, only those components are described which differ from those shown for the first embodiment in FIG. 1. In FIG. 4, the first conveyor 3 is shown as the only element of the feed unit 4. A printed product 2 positioned on this conveyor 3 is initially transported in the feed direction 4*a* and is subsequently transferred to the second conveyor 5 which then conveys the printed product further in the removal direction 6*a*. A modified press-on unit 17 is used with this embodiment for the above-described steps involving the transfer and diverting of the printed products 2. The device 1 is furthermore provided with a transfer-out unit 43 for transferring out at least one printed product 2, wherein this unit can be added and is arranged on the side of the second conveyor 5 that is located opposite the transfer region 7 of the first conveyor 3. The transfer-out unit 43 is shown and described in connection with this embodiment, but can of course also be provided on all other embodiments of the invention. This unit permits the transfer out of selected printed products 2 in a transfer-out direction 44. For example, this function can be used for the quality control, for separating out random samples of the printed products during the normal production sequence and for checking these samples, as well as for transferring out printed products 2 of poor quality. Transfer-out units are known per se and are not explained in further detail herein.

Figure 4B:
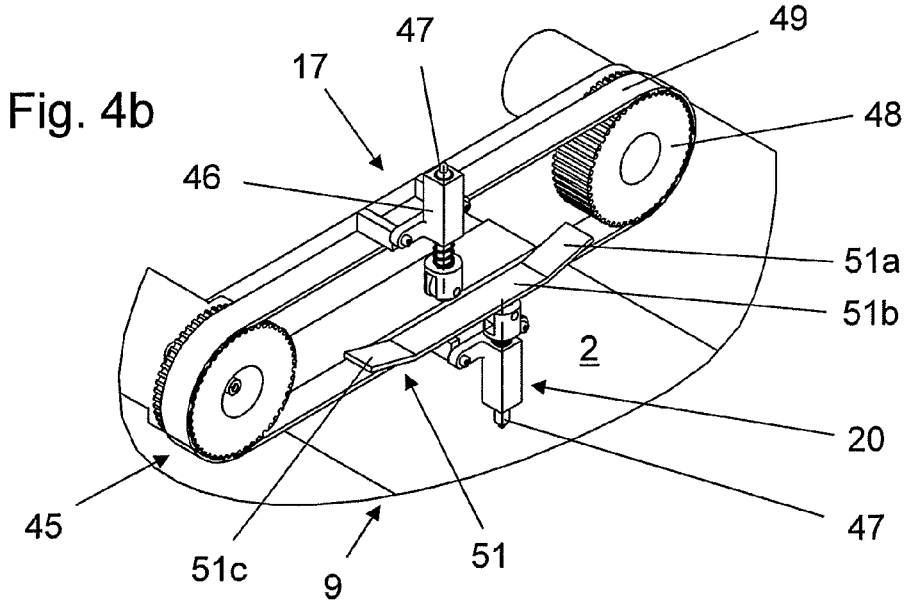
FIG. 4*b* An enlarged detail from FIG. 4*a;*

For reasons of a better overview, FIG. 4*b* shows an enlarged representation of the relevant components for operating the device with the modified press-on unit 17. In this second embodiment, the pressing element 20 contains a pressing ram 46 that is attached to a belt drive 45. A springy pressure member 47 is arranged on the exposed tip of the pressing ram 46. The force of the pressure exerted onto the printed product 2 can be adjusted via this pressure member 47. Differences in the thickness, such as can be found between printed products provided with inserts 23 and those without inserts, can furthermore also be compensated in this way. The pressing ram 46 is embodied such that it can circulate with the aid of the belt drive 45, consisting of a belt 49 that moves around two gears 48. The belt drive 45 is driven by a drive 50 which can be embodied as a servo-motor or also as a stepping motor. As an alternative to the belt drive 45, a chain drive can also be provided. In FIGS. 4*a* and 4*b*, the pressing ram 46 which circulates jointly with the belt 49 and the gears 48 is shown in a passive or non-operating position. In the operating or active position, the pressing ram 46 exerts pressure on the printed product 2 in the takeover region 8, using the pressure member 47 which is oriented toward the printed product. In the non-operating or passive position, the pressing ram 46 is located above the takeover region 8 and the pressure member 47 is pointing away from it. In its operating position, the pressing ram 46 is moved on the lower belt section of the belt 49 in removal direction 6*a* by the removal unit 6. In its non-operating position, the pressing ram is moved on the upper belt section of the belt 49, counter to the removal direction 6*a*. During the transport on the lower section of the belt 49, the essentially vertically arranged pressing ram 46 is moved against a guide curve 51, embodied as curved metal sheet. In the process, the springy pressure member 47 is simultaneously pushed against the printed product 2 during the movement in the removal direction 6*a* of the pressing ram 46. In the region of the guide curve 51, the pressing element 20 can be provided with additional guides that are not shown herein. The pressing element 20 can furthermore be vertically adjustable with the aid of devices which are also not shown herein and can thus be adapted individually to different product thicknesses. As an alternative to the fixedly mounted guide curve 51, the pressing element 20 can also be added to operate in the vertical direction, for example with the aid of a pneumatic cylinder or a linear motor.

The pressing element 20 is accordingly provided with a pressing ram 46 that can be moved with the aid of the drive 50 at the speed of the second conveyor 5 in removal direction 6*a*, or counter thereto, and can be lifted and/or lowered with the aid of the guide curve 51. The pressing ram initially supports the movement of the printed product 2 along the trajectory in the direction of the support surface 9 of the takeover region 8 of the removal unit 6 and subsequently presses the printed product 2, which is deposited on the support surface 9 and is accelerated in removal direction 6*a*, against the second conveyor 5.

The transfer supported by the press-on unit 17 of the printed products 2 from the first conveyor 3 is explained in further detail in the following. Pressure is exerted along the trajectory onto the printed product 2 by the pressing ram 46 which is controlled mechanically for the illustrative embodiment, thus supporting the movement of the printed product 2 in the direction of the support surface 9 of the takeover region 8 of the removal unit 6. This takes place in a first region 51*a* of the guide curve 51, in which the pressing ram 46 moves in the direction of the support surface 9 of the takeover region 8. In a second region 51*b* of the guide curve 51, the pressing ram 46 moves parallel to the second conveyor 5, thereby pressing the printed product 2 which also moves along during the acceleration against the conveyor 5. In a third region 51*c* of the guide curve 51, the pressing ram 46 is again lifted off the second conveyor 5 and thus leaves its active or operating position. The gears 48 are operated with the aid of the control unit 16 and the drive 50, for example, with a rotational speed which ensures that the pressing ram 46 in the second region 51*b* of the guide curve 51 essentially operates at the speed of the second conveyor 5. As seen in the removal direction 6*a*, the pressing ram 46 is pushed downward during the first contact with the guide curve 51, thus pressing the printed product 2 against the second conveyor 5, where it is decelerated in feed direction 4*a* and simultaneously accelerated in removal direction 6*a*. Of course, the shape and the position of the guide curve 51 are decisive for the movement of the pressing ram 46, wherein the guide curve 51 can also have a different shape than the one shown in FIG. 4*b*. For example, the corners between the above-defined regions 51*a*, 51*b* and 51*c* can also be round. The length of time for the pressing-on can also be adjusted, based on the total form and the length of the second region 51*b* of the guide curve 51. Of course, the guide curve 51 can also be replaced in order to adapt to different formats of the printed product 2. Depending on the width and/or the length of the printed product 2, a shorter or a longer pressing operation can be used and can be adjusted via different guide curves 51. If an active element is alternatively used, as mentioned in the above, this element can preferably move vertically up and down following a command issued by the control unit 16 for the up and/or down movement, such that the point in time for the pressing down and the duration of the length of time for the pressing operation can be adjusted. The use of an active element is explained in further detail in the following with the aid of the third embodiment and FIGS. 5*a* and 5*b*.

Figure 5A:
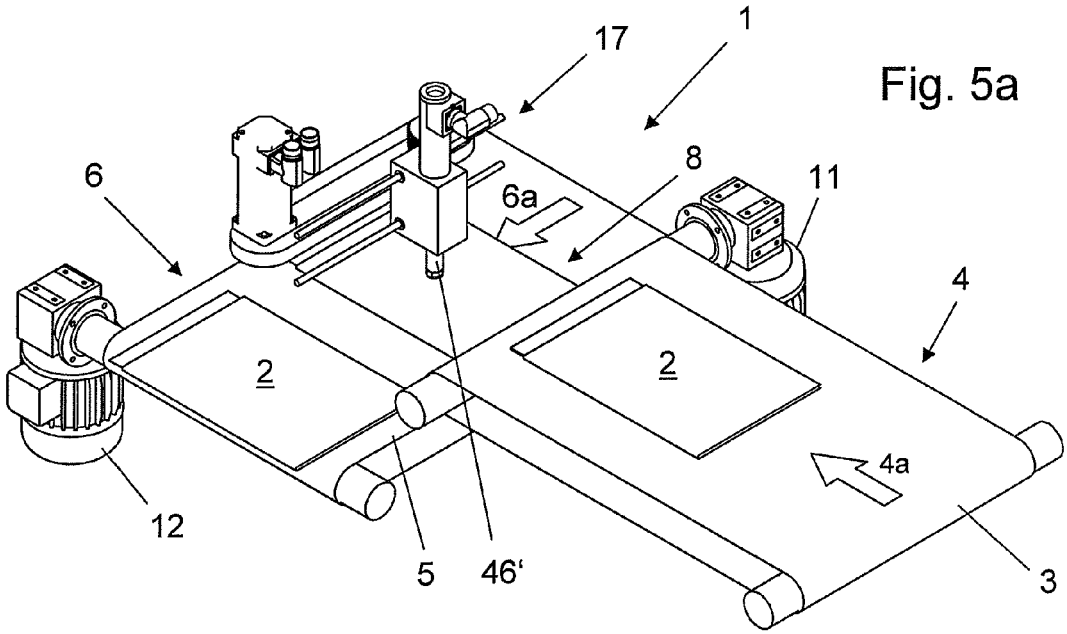
FIG. 5*a* A perspective view of a third embodiment of a device for transferring printed products.
Figure 5B:
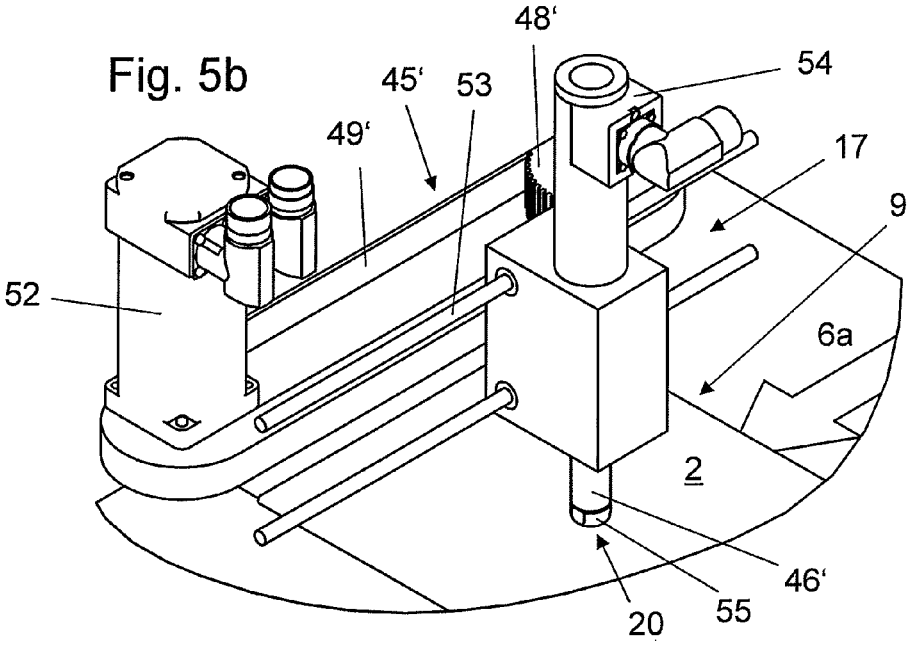
FIG. 5*b* An enlarged detail from FIG. 5*a;*

FIG. 5*a* shows a perspective view of a third embodiment of the invention. On the first conveyor 3, shown as the only element of the feed unit 4, a printed product 2 is transported in the feed direction 4*a*, is then transferred to the removal unit 6 and is conveyed on this unit in the removal direction 6*a*. For the present embodiment, a modified press-on unit 17 is used for the above-described transfer and the diverting of the printed products 2.

In this third embodiment, the pressing element 20 is also provided with a pressing ram 46' which is driven with the aid of a belt drive 45' or, alternatively, with the aid of a chain drive that is not shown herein. A belt 49' and a gear 48' of the belt drive 45' are moved with the aid of a drive 52, for example embodied as a servo-motor or a crank mechanism. The pressing ram 46' can be moved horizontally with the speed of the second conveyor 5 along rod-shaped guide elements 53 in the removal direction 6*a* or counter thereto. The pressing ram 46' can additionally also be moved vertically with the aid of a drive 54, for example a linear motor, a servo-motor, a pneumatic cylinder or a crank mechanism. In the same way as for the previous embodiments, the pressing ram 46' initially supports the movement of the printed product 2 in the direction toward the support surface 9 of the takeover region 8 of the removal unit 6 and subsequently presses the deposited printed product 2 during the acceleration in the removal direction 6*a* onto the second conveyor 5. The guide elements 53 also function to absorb the forces generated during the pressing on of the printed product 2. Of course, other suitable guide elements 53 can also be used.

At the start of the transfer, the pressing ram 46' is lowered from its idle position, such that it exerts pressure on the printed product 2 moving along the trajectory, thereby supporting its movements in the direction of the support surface 9 of the takeover region 8. In the process, the pressing ram 46' preferably executes a movement in the removal direction 6*a*. This movement is controlled by the drive 52 and essentially occurs at the speed of the second conveyor 5. Following this, the pressing ram 46' presses the printed product 2 that travels along against the second conveyor 5. The pressing ram 46' comprises a tip 55 which is positioned springy, in the same way as the pressure member 47 of the pressing ram 46 of the second illustrative embodiment. At the end of the pressing operation, the pressing element 20 is stopped as quickly as possible, the pressing ram 46' is lifted up and the pressing element 20 is moved back to the idle position. In this case, the return speed for the pressing element 20 to the idle position can be different, preferably be higher, than the speed during the pressing operation. The return speed can be adjusted in dependence on the product division on the first conveyor 3, thus resulting in the requirement that the drive 52 must alternate between the two rotational directions for the belt 49. The control unit 16 takes over the synchronization of the movement sequence, as well as the speed profile connected thereto. It can furthermore be determined with the aid of the control unit 16, within the framework of the dynamic of the selected drive 52, how fast the pressing ram 46' is accelerated for the respective movement in the removal direction 6*a* or counter thereto. The adjustment of the pressing distance length can occur individually via the control unit 16.

For all embodiments, two or more pressing elements 20 can also be provided which are successively arranged in the removal direction 6*a*. The mode of operation of the elements is similar to that explained in connection with the first embodiment.

Figure 6A:
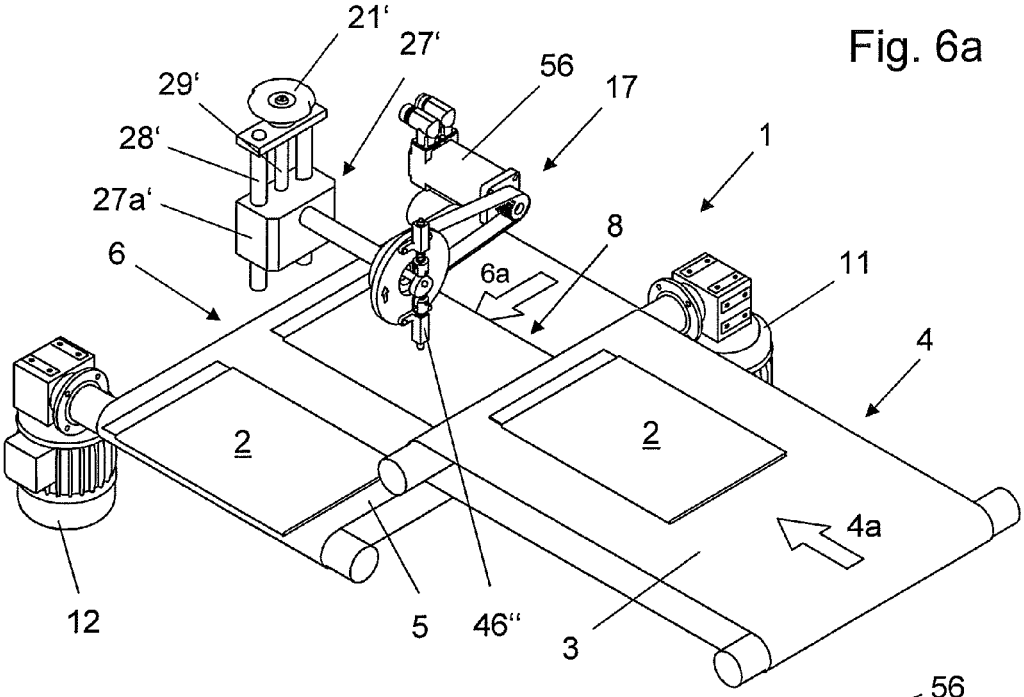
FIG. 6*a* A perspective view of a fourth embodiment of a device for transferring printed products.
Figure 6B:
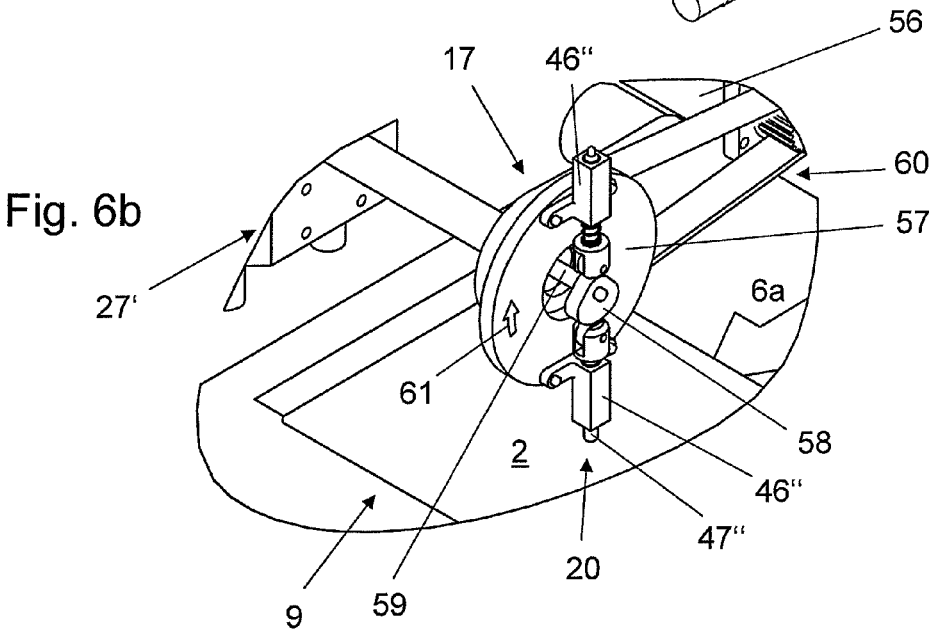
FIG. 6*b* An enlarged detail from FIG. 6*a;*

FIG. 6*a* shows a perspective view of a fourth embodiment of the invention. A printed product 2 is transported in the feed direction 4*a* on the conveyor 3 which is again shown as the only element of the feed unit 4. The printed product 2 is then transferred to the takeover region 8 of the removal unit 6 and is transported with its second conveyor 5 in the removal direction 6*a*. For the above-described transfer and diverting of the printed product 2, this embodiment again makes use of a modified press-on unit 17, wherein the pressing element 20 of the press-on unit 17 is shown enlarged in FIG. 6*b*.

Two pressing elements 20 are rigidly attached to a stationary disk 57 that can be rotated at a variable speed with the aid of a drive 56. The pressing elements are provided with a pressing ram 46" which can be lifted or lowered by rotating it around a cam disk 58, relative to the support surface 9 of the takeover region 8. Respectively one of the pressing rams 46" exerts pressure from above onto the printed product 2, supports its movement in the direction of the support surface 9 of the takeover region 8, and subsequently presses the deposited printed product 2 against the support surface 9 and/or the second conveyor 5 during the diverting as well as the acceleration in removal direction 6*a*.

The cam disk 58 is attached to a rigid axis 59. The latter is attached to a sliding member 27*a*' of a slide 27' which can be lifted or lowered in vertical direction along two guide rods 28' and can be admitted with the aid of an adjustment wheel 21', via a threaded rod 29', wherein the adjustment can also be automatic, of course, with the aid of a motor. The disk 57 and thus also the pressing ram 46" are driven, starting with the belt drive 56 via a belt drive 60 or also a chain drive, in the rotational direction 61. The pressing rams 46" are attached to the disk 57 surface which faces the feed unit 4. According to FIGS. 6*a* and 6*b*, the press-on unit 17 comprises two pressing rams 46" with respectively one pressure member 47" which, starting with the center of the disk 57, are arranged along a diameter line. Also conceivable, of course, is the use of more than two pressing rams or of only a single pressing ram 46".

Figure 6C:
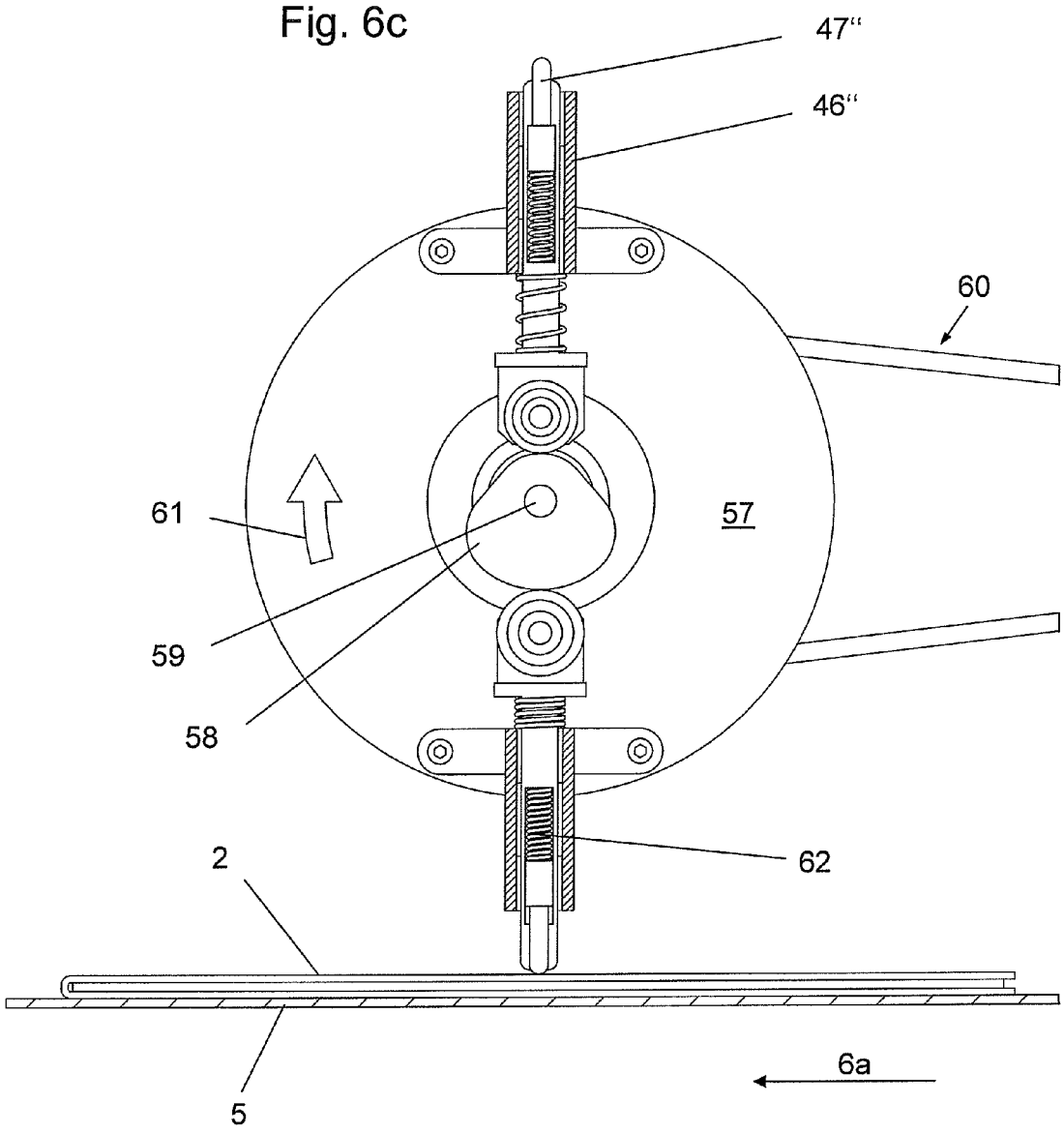
FIG. 6*c* An enlarged view from the side of the pressing element shown in FIG. 6*a.*

Respectively one pressure member 47" that is connected to a spring element 62 is arranged in the pressing rams 46" and is adjusted such that during the movement of the disk 57 in rotational direction 61, the pressing member 47" initially makes contact with the printed product 2 before reaching the lowest point. With a further movement, the pressure member 47" presses the printed product 2 long enough against the support surface 9 of the takeover region 8, meaning against the second conveyor 5, until the pressing ram 46" is again lifted off the printed product in a downstream region of the disk 57. Starting with the first contact with the printed product 2, the spring element 62 is increasingly tensioned and then starts relaxing again after reaching the lowest point of the pressure member 47" until it is lifted off once more (FIG. 6*c*).

The disk 57 advantageously operates with a variable rotational speed. By viewing the movement described by the pressing ram 46", the speed component of the pressing ram 46" that is parallel to the removal direction 6*a* during the first contact of the pressure member 47" with the printed product 2 should preferably be lower than the speed of the second conveyor 5. During the further rotation of the disk 57, its rotational speed is controlled such that the share of the speed component of the pressing ram 46" increases constantly until it reaches the speed of the second conveyor 5, meaning as long as the pressing ram 46" acts upon the printed product 2. The instant when the pressing ram 46" reaches the speed of the second conveyor 5 can be varied, depending on the requirements. For example, the rotational speed of the disk 57 can be maintained between the first contact point of the pressing member 47" and the printed product 2 until the pressure member 47" reaches the lowest point because the pressing ram 46" is already accelerated in the removal direction 6*a* during this interval as a result of the contact with the printed product 2. Once the pressing member 47" has reached the lowest point and until it is lifted up, the rotational speed of the disk 57 increases to counteract the decrease in the speed component of the pressing ram 46" in removal direction 6*a*. This cyclical process is repeated for each pressing ram 46" which acts upon a printed product 2 that is conveyed to the takeover region 8. The course of the rotational speed of the disk 57 can also be configured to differ from the one described herein. In particular when using a single pressing ram 46", this ram can be accelerated and/or delayed after being lifted off the preceding printed product 2 until the first contact of the pressing member 47" with the following printed product 2, to adapt the following operational step to the product division that exists on the first conveyor 3.

For the second, third and fourth embodiment, the press-on unit 17 is attached to a frame 18. On this frame 18, the idle position of the respective pressing ram 46, 46', 46" can be adjusted essentially parallel to the support surface 9 of the takeover region 8 analogous to the first embodiment, so that during the lowering of the pressing ram 46, 46', 46" the printed product 2 is admitted with pressure at least approximately in the center of the leading edge, as seen in the removal direction 6*a*.

In the course of describing the various embodiments of the device 1, multiple references were made to the control unit 16. In the following, it is explained how the individual elements are controlled and which deciding criteria play a role for the selection of various control options.

Depending on the configuration of the device 1, the control unit 16 is connected to the drive 11 of the first conveyor 3, the drive 12 of the second conveyor 5, to at least one drive 19, 40, 50, 52, 54, 56 of the respective pressing element 20, to the pressure rollers 13, the detection device 15 and the sensor 34.

A central task of the control unit 16 is to synchronize with the aid of the respective drives 19, 50, 54, 56 the vertical movements of the pressing element 20, meaning its lowering toward the support surface 9 or toward a printed product 2, conveyed in a stream of individual products, which is moving in the direction of the support surface 9 or the lifting up from the support surface 9 or from a thereon positioned printed product 2 with the product division of the stream of individual printed products 2 as conveyed on the conveyor 3. This is achieved by dynamically adapting the instant when the pressing element 20 is lowered and/or lifted up, in dependence on the product division, as explained in the following with the aid of the first embodiment of the invention. For this, two successively following printed products 2 are observed, wherein at the start of the observation the first printed product 2 enters the transfer region 7 of the feed unit 4. The following steps are intended for the synchronizing:

a) The detection device 15 in the form of a light barrier records the initial entrance of a first printed product 2 into its operational sphere by recording the interruption of a light beam between a light source and a receiver of the detection device 15, caused by a leading edge of the printed product 2, whereupon the detection device transmits a corresponding first signal to the control unit 16. As soon as the light beam is no longer interrupted, the detection device 15 transmits to the control unit 16 a second signal which relates to the point in time when the rear edge of the same printed product 2 arrives. The control unit 16, which also knows the speed of the first conveyor 3, then determines the respective format of the printed product 2.

b) Once it receives the second signal from the detection device 15, the control unit 16 transmits a signal to the drive 19 for lowering the pressing element 20. As a result, the pressure roller 22 is lowered from its idle position above the takeover region 8 and can thus act upon the printed product 2 which meanwhile moves along its trajectory.

c) As soon as the detection device 15 has detected the leading edge of the printed product 2 that follows the first printed product 2, it transmits a corresponding additional signal to the control unit 16. The control unit then computes the actual product division and compares it to the desired product division. If the distance to the following printed product 2, determined in this way, falls below a fixed limit value, then the control unit 16 transmits to the drive 19 a signal for lifting up the pressing element 20. As a result, the pressure roller 22 is lifted ahead of time from the operating position on the preceding printed product to the idle position, thereby avoiding a collision between the pressing element 20 and the following printed product 2.

The above described control method can be also used for the other embodiments of the invention. However, if several pressing rams 46" are used for the fourth embodiment, these must be moved so that in the rotational direction 61 the respectively following printed product 2 is not hindered. If necessary, the disk 57 can be stopped briefly in that case.

According to an embodiment, the control unit 16 is connected to the drive 12 for the second conveyor 5. The conveying speed of the second conveyor 5 can then be adjusted so that an overlapping stream or a stream of individual products can optionally be formed with the diverted printed products 2. If the conveying speed of the second conveyor 5 is lower than the conveying speed of the first conveyor 3, an overlapping stream can be formed on the second conveyor 5. The spacing in the overlapping stream can furthermore be adjusted through a precise adjustment of the conveying speeds of the conveys 3, 5. If the conveying speed of the second conveyor 5 is selected to be higher than that of the first conveyor 3, then a stream of individual printed products 2 is created. The larger the speed difference in that case, the larger the product division on the second conveyor 5. This adjustment option has the advantage that simultaneous with the diverting operation, the device 1 can also adapt the single-sheet stream for a following processing machine with respect to the format, thereby combining two processing steps into one step.

Even though advantageous embodiments of the invention are shown and described, the invention is not limited to these embodiments but can be configured and used differently within the scope of application of the following claims.

It will be understood that the above description of the present invention is susceptible to various modifications, changes and adaptations, and the same are intended to be comprehended within the meaning and range of equivalents of the appended claims.

What is claimed is:

1. A device to transfer printed products conveyed in a stream of single products, comprising:

a feed unit including a first conveyor that conveys the stream of single products in a feed direction, wherein the feed unit includes a transfer region;

a removal unit including a second conveyor having a support surface to convey the printed products in a removal direction, wherein the removal unit includes a takeover region downstream of the transfer region formed by the support surface, wherein the transfer region is arranged higher than the takeover region which receives the printed products from the transfer region of the first conveyor;

a pressing element arranged above the support surface and operable to be lowered toward a printed product conveyed in the single stream and to be moved in a direction of the support surface, wherein the pressing element is further operable to be lifted off the printed product positioned on the support surface; and a control unit to control the pressing element to come in contact with the respective print products from the top during transfer from the feed unit to the removal unit in the transfer region, before the printed products impact with the support surface in the takeover region, whereby the printed products are slowed down in the feed direction by the pressing element which also diverts the printed products from the feed direction to the removal direction.

2. The device according to claim 1, wherein the first conveyor has an imaginary center line extending parallel to the feed direction, the second conveyor has an imaginary center line extending parallel to the removal direction, a first vertical plane extends through the center line of the first conveyor and intersects a second vertical plane that extends through the center line of the second conveyor to form a joint intersecting line, and the pressing element is arranged at least approximately in a region of the joint intersecting line.

3. The device according to claim 1, wherein the pressing element is adapted to be height adjustable.

4. The device according to claim 3, further comprising a first drive for the first conveyor, a second drive for the second conveyor, at least one drive for the pressing element, and a detection device to detect a printed product transported in the feed unit, wherein the control unit is connected to the first drive, the second drive, the at least one drive for the pressing element and the detection device.

5. The device according to claim 4, wherein the pressing element comprises at least one pressure roller rotatable in the removal direction and attached to the at least one drive of the pressing element to form a press-on unit that is displaceable to be lifted and lowered.

6. The device according to claim 5, wherein the pressure roller has a shaft and further including a another drive connected to the shaft of the pressure roller.

7. The device according to claim 1, wherein the at least one pressing element includes at least two pressing elements arranged successively in the removal direction.

8. The device according to claim 1, further comprising at least one pressure roller arranged in the transfer region of the feed unit and adapted to exert pressure onto the printed products.

9. The device according to claim 1, further including a transfer-out unit arranged on a side of the removal unit located opposite the transfer region of the feed unit, whereby a printed product can be transferred out of the stream of single printed products.

10. A device to transfer printed products conveyed in a stream of single products, comprising:

a feed unit including a first conveyor that conveys the stream of single products in a feed direction, wherein the feed unit includes a transfer region;

a removal unit including a second conveyor to convey the printed products in removal direction, wherein the removal unit includes a takeover region and the second conveyor presents a support surface for the takeover region, wherein the transfer region is arranged higher than the takeover region which receives the printed products from the transfer region of the first conveyor, whereby the printed products are diverted from the feed direction to the removal direction during transfer from the feed unit to the removal unit;

a height adjustable pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface, wherein the pressing element comprises at least one pressure roller rotatable in the removal direction and attached to the at least one drive of the pressing element to form a press-on unit that is displaceable to be lifted and lowered;

a frame, a first slide operable to be lifted and lowered, the press-on unit being arranged on the first slide, a second slide, displaceable in and counter to the feed direction, the first slide being arranged on the second slide, and a third slide displaceable on the frame in and counter to the removal direction, the second slide being arranged on the third slide; and a first drive for the first conveyor, a second drive for the second conveyor, at least one drive for the pressing element and a detection device to detect a printed product transported in the feed unit, and a control unit, wherein the control unit is connected to the first drive, the second drive, the at least one drive for the pressing element and the detection device.

11. A device to transfer printed products conveyed in a stream of single products, comprising:

a feed unit including a first conveyor that conveys the stream of single products in a feed direction, wherein the feed unit includes a transfer region;

a removal unit including a second conveyor to convey the printed products in removal direction, wherein the removal unit includes a takeover region and the second conveyor presents a support surface for the takeover region, wherein the transfer region is arranged higher than the takeover region which receives the printed products from the transfer region of the first conveyor, whereby the printed products are diverted from the feed direction to the removal direction during transfer from the feed unit to the removal unit; and a height adjustable pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface, wherein the pressing element includes at least one pressing ram coupled to the at least one drive of the pressing element for movement at a speed of the second conveyor in the removal direction or counter to the removal direction, and further including a guide cam arranged to lower and lift the pressing ram; and a first drive for the first conveyor, a second drive for the second conveyor, at least one drive for the pressing element, and a detection device to detect a printed product transported in the feed unit, and a control unit, wherein the control unit is connected to the first drive, the second drive, the at least one drive for the pressing element and the detection device.

12. A device to transfer printed products conveyed in a stream of single products, comprising:

a feed unit including a first conveyor that conveys the stream of single products in a feed direction, wherein the feed unit includes a transfer region., a removal unit including a second conveyor to convey the printed products in removal direction, wherein the removal unit includes a takeover region and the second conveyor presents a support surface for the takeover region, wherein the transfer region is arranged higher than the takeover region which receives the printed products from the transfer region of the first conveyor, whereby the printed products are diverted from the feed direction to the removal direction during transfer from the feed unit to the removal unit;

a height adjustable pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface; and a first drive for the first conveyor, a second drive for the second conveyor, at least one drive for the pressing element, and a detection device to detect a printed product transported in the feed unit, and a control unit, wherein the control unit is connected to the first drive, the second drive, the at least one drive for the pressing element and the detection device;

wherein the removal unit includes guide elements extending in the removal direction, the pressing element includes at least one pressing ram, and the at least one drive of the pressing element includes one drive coupled to the at least one pressing ram to lift and lower the pressing ram, and the device further includes another drive coupled to move the pressing element along the guide elements of the removal unit in or counter to the removal direction.

13. A device to transfer printed products conveyed in a stream of single products, comprising:

a feed unit including a first conveyor that conveys the stream of single products in a feed direction, wherein the feed unit includes a transfer region;

a removal unit including a second conveyor to convey the printed products in removal direction, wherein the removal unit includes a takeover region and the second conveyor presents a support surface for the takeover region, wherein the transfer region is arranged higher than the takeover region which receives the printed products from the transfer region of the first conveyor, whereby the printed products are diverted from the feed direction to the removal direction during transfer from the feed unit to the removal unit; and a height adjustable pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface; and a first drive for the first conveyor, a second drive for the second conveyor, at least one drive for the pressing element, and a detection device to detect a printed product transported in the feed unit, and a control unit, wherein the control unit is connected to the first drive, the second drive, the at least one drive for the pressing element and the detection device;

wherein at least one of the drives for the pressing element comprises a linear motor with a fixed or variable stroke.

14. A device to transfer printed products conveyed in a stream of single products, comprising:

a feed unit including a first conveyor that conveys the stream of single products in a feed direction, wherein the feed unit includes a transfer region;

a removal unit including a second conveyor to convey the printed products in removal direction, wherein the removal unit includes a takeover region and the second conveyor presents a support surface for the takeover region, wherein the transfer region is arranged higher than the takeover re ion which receives the printed products from the transfer region of the first conveyor, whereby the printed products are diverted from the feed direction to the removal direction during transfer from the feed unit to the removal unit; and a height adjustable pressing element arranged above the support surface and operable to be lowered toward the support surface or toward a printed product conveyed in the single stream and moving in a direction of the support surface, wherein the pressing element is further operable to be lifted off the support surface or a printed product positioned on the support surface; and a first drive for the first conveyor, a second drive for the second conveyor, at least one drive for the pressing element, and a detection device to detect a printed product transported in the feed unit, and a control unit, wherein the control unit is connected to the first drive, the second drive, the at least one drive for the pressing element and the detection device;

wherein the pressing element comprises a stationary disk and the at least one drive of the pressing element is coupled to move the stationary disk with a variable rotational speed, and wherein the pressing element further includes at least one pressing ram rigidly connected to the stationary disk, the at least one pressing ram being lowered and lifted, relative to the support surface of the takeover region by turning the stationary disk.

15. The device according to claim 14, wherein the pressing element includes a spring element and a pressing member connected to spring element and arranged in the at least one pressing ram.

16. A method to transfer printed products conveyed in a stream of individual printed products by a first conveyor of a feed unit to a removal unit, comprising:

transferring the printed products from a transfer region of the feed unit to a support surface, arranged below the transfer region, of a takeover region of the removal unit, the transferring including diverting the printed products from a feed direction to a removal direction by causing the pressing element to come in contact with the respective print products from the to during transfer from the feed unit to the removal unit in the transfer region, before the printed products impact with the support surface in the takeover region;

slowing down the printed products in the feed direction during the transferring;

pressing the printed products, respectively, against the support surface of the takeover region during the transferring; and accelerating the printed products, respectively, in the removal direction during the diverting step.

17. The method according to claim 16, including continuously diverting the printed products from the feed direction to the removal direction during the transferring step.

18. The method according to claim 16, wherein during the transferring of a respective one of the printed products, the pressing includes lowering the pressing element from an upper idle position above the support surface of the takeover region, admitting the printed product with pressure from above to slow the printed product in the feed direction while supporting a movement of the printed product in the removal direction, pressing the printed product against the support surface while being diverted, accelerating the printed product in the removal direction, and finally lifting the pressing element off the printed product.

19. A method to transfer printed products conveyed in a stream of individual printed products by a first conveyor of a feed unit to a removal unit, comprising:

transferring the printed products from a transfer region of the feed unit to a support surface, arranged below the transfer region, of a takeover region of the removal unit, the transferring including diverting the printed products from a feed direction to a removal direction;

slowing down the printed products in the feed direction during the transferring;

pressing the printed products, respectively, against the support surface of the takeover region during the transferring;

accelerating the printed products, respectively, in the removal direction during the diverting step;

wherein during the transferring of a respective one of the printed products, the pressing includes lowering the pressing element from an upper idle position above the support surface of the takeover region, admitting the printed product with pressure from above to slow the printed product in the feed direction while supporting a movement of the printed product in the removal direction, pressing the printed product against the support surface while being diverted, accelerating the printed product in the removal direction, and finally lifting the pressing element off the printed product; and adjusting an idle position of the pressing element in dependence on a format of the printed product so that the pressing element is essentially parallel to the support surface in the takeover region and that during the lowering of the pressing element the printed product is admitted with pressure at least approximately in a center of a leading edge as seen in the removal direction.

20. A method to transfer printed products conveyed in a stream of individual printed products by a first conveyor of a feed unit to a removal unit, comprising:

transferring the printed products from a transfer region of the feed unit to a support surface, arranged below the transfer region, of a takeover region of the removal unit, the transferring including diverting the printed products from a feed direction to a removal direction;

slowing down the printed products in the feed direction during the transferring;

pressing the printed products, respectively, against the support surface of the takeover region during the transferring;

accelerating the printed products, respectively, in the removal direction during the diverting step;

wherein during the transferring of a respective one of the printed products, the pressing includes lowering the pressing element from an upper idle position above the support surface of the takeover region, admitting the printed product with pressure from above to slow the printed product in the feed direction while supporting a movement of the printed product in the removal direction, pressing the printed product against the support surface while being diverted, accelerating the printed product in the removal direction, and finally lifting the pressing element off the printed product; and synchronizing at least one of lowering and lifting of the pressing element with a product division of the printed products, conveyed in the transfer region of the feed unit through dynamically adapting the lowering and/or lifting moment in dependence on the product division.

21. A method to transfer printed products conveyed in a stream of individual printed products by a first conveyor of a feed unit to a removal unit that includes a second conveyor with a takeover region having a support surface, comprising:

transferring the printed products from a transfer region of the feed unit to the support surface of the second conveyor, arranged below the transfer region, the transferring including diverting the printed products from a feed direction to a removal direction;

slowing down the printed products in the feed direction during the transferring;

pressing the printed products, respectively, against the support surface of the takeover region during the transferring;

accelerating the printed products, respectively, in the removal direction during the diverting step; and adjusting the conveying speed of the second conveyor such that a stream of single products or an overlapping stream of products is selectively formed with the diverted printed products.

22. A method to transfer printed products conveyed in a stream of individual printed products by a first conveyor of a feed unit to a removal unit, comprising:

transferring the printed products from a transfer region of the feed unit to a support surface, arranged below the transfer region, of a takeover region of the removal unit, the transferring including diverting the printed products from a feed direction to a removal direction;

slowing down the printed products in the feed direction during the transferring;

pressing the printed products, respectively, against the support surface of the takeover region during the transferring;

accelerating the printed products, respectively, in the removal direction during the diverting step; and detecting at least one of an acceleration time and an acceleration distance for the printed products conveyed on the removal unit and lifting up the pressing element once a desired acceleration time is reached and/or a desired acceleration distance is traveled by the printed product.

* * * * *